US010600563B2

(12) United States Patent
Jang et al.

(10) Patent No.: US 10,600,563 B2
(45) Date of Patent: Mar. 24, 2020

(54) MAGNETIC-SHIELD-TYPE CONVERTER

(71) Applicant: AMOGREENTECH CO., LTD., Gyeonggi-do (KR)

(72) Inventors: Dong Wook Jang, Gyeonggi-do (KR); Cholhan Kim, Incheon (KR)

(73) Assignee: AMOGREENTECH CO., LTD., Gyeonggi-do (KR)

( * ) Notice: Subject to any disclaimer, the term of this patent is extended or adjusted under 35 U.S.C. 154(b) by 0 days.

(21) Appl. No.: 16/061,094

(22) PCT Filed: Dec. 9, 2016

(86) PCT No.: PCT/KR2016/014410

§ 371 (c)(1),
(2) Date: Jun. 11, 2018

(87) PCT Pub. No.: WO2017/099502

PCT Pub. Date: Jun. 15, 2017

(65) Prior Publication Data

US 2018/0366265 A1 Dec. 20, 2018

(30) Foreign Application Priority Data

Dec. 11, 2015 (KR) ..... 10-2015-0177272

(51) Int. Cl.
*H01F 27/36* (2006.01)
*H01F 38/28* (2006.01)
(Continued)

(52) U.S. Cl.
CPC ..... *H01F 27/365* (2013.01); *H01F 27/02* (2013.01); *H01F 27/25* (2013.01); *H01F 27/266* (2013.01);
(Continued)

(58) Field of Classification Search
CPC ... H01F 27/365; H01F 38/28; H01F 2038/305
See application file for complete search history.

(56) References Cited

U.S. PATENT DOCUMENTS 4,779,812 A * 10/1988 Fisher ..... H01F 27/322 242/434.7
5,066,904 A * 11/1991 Bullock ..... G01R 15/185 323/357
(Continued)

FOREIGN PATENT DOCUMENTS

EP 0509936 A2 * 10/1992 ..... H01F 27/26
EP 2423693 2/2012
(Continued)

OTHER PUBLICATIONS

International Search Report issued in International Patent Application No. PCT/KR2016/014410, dated Apr. 14, 2017.
(Continued)

*Primary Examiner* — Elvin G Enad
*Assistant Examiner* — Malcolm Barnes
(74) *Attorney, Agent, or Firm* — Norton Rose Fulbright US LLP

(57) ABSTRACT

A magnetically shielded current transformer is provided, which includes a magnetic core module including a core formed in a ring shape by winding plate shape ribbon a plurality of times, a bobbin configured to accommodate the core, and a coil configured to be wound along an outer circumferential surface of the bobbin; a shielding member which is configured to surround an outer circumferential surface and both side surfaces of the magnetic core module, includes through-holes at centers of the both side surfaces, and is formed of iron; and an outer case configured to protect the magnetic core module and the shielding member. Accordingly, a magnetic path is formed by an external magnetic field, which is applied from the outside, via the
(Continued)

shielding member and thus the external magnetic field is prevented from being transferred to the magnetic core module, thereby stably blocking influences caused by the external magnetic field.

11 Claims, 6 Drawing Sheets

(51) Int. Cl.

| | |
|---|---|
| ***H01F 38/30*** | (2006.01) |
| ***H01F 27/02*** | (2006.01) |
| ***H01F 27/25*** | (2006.01) |
| ***H01F 27/30*** | (2006.01) |
| ***H01F 27/26*** | (2006.01) |
| ***H01F 27/32*** | (2006.01) |

(52) U.S. Cl.
CPC ..... *H01F 27/306* (2013.01); *H01F 27/325* (2013.01); *H01F 38/30* (2013.01); *H01F 27/32* (2013.01)

(56) References Cited

U.S. PATENT DOCUMENTS

| | | | | | |
|---|---|---|---|---|---|
| 5,828,282 | A * | 10/1998 | Tiemann | H01F 27/365 | 336/84 R |
| 6,512,438 | B1 * | 1/2003 | Yoshimori | H01F 17/062 | 336/178 |
| 6,753,749 | B1 * | 6/2004 | Chin | H01F 27/027 | 336/83 |
| 8,238,066 | B2 * | 8/2012 | Zylstra | G01R 15/183 | 361/42 |
| 9,285,398 | B2 * | 3/2016 | Lu | G01R 19/0046 | |
| 2010/0201472 | A1 * | 8/2010 | Le | H01F 27/02 | 336/96 |
| 2013/0200971 | A1 * | 8/2013 | Crutcher | H01F 27/24 | 336/90 |
| 2016/0041204 | A1 * | 2/2016 | Bietz | G01R 15/18 | 324/127 |

FOREIGN PATENT DOCUMENTS

| | | | | |
|---|---|---|---|---|
| EP | 2700953 | | 2/2014 | |
| EP | 2700953 | A2 * | 2/2014 | G01R 15/183 |
| JP | S 63128705 | | 6/1988 | |
| JP | 05152148 | A * | 6/1993 | |
| JP | H 05152148 | | 6/1993 | |
| JP | 06267396 | A * | 9/1994 | |
| JP | H 06267396 | | 9/1994 | |
| JP | H 08331062 | | 12/1996 | |
| JP | H 09148141 | | 6/1997 | |
| JP | 2000-331854 | | 11/2000 | |
| JP | 2002530853 | | 9/2002 | |
| JP | 2007299838 | | 11/2007 | |
| JP | 2011-003560 | | 1/2011 | |
| JP | 2011-243773 | | 12/2011 | |
| JP | 2012112947 | | 6/2012 | |
| JP | 2012124396 | | 6/2012 | |
| KR | 10-2004-0100787 | | 12/2004 | |
| KR | 10-2009-0108165 | | 10/2009 | |
| KR | 20090108165 | A * | 10/2009 | |
| KR | 20090108165 | A * | 10/2009 | H01F 27/24 |
| KR | 10-1227905 | | 1/2013 | |
| KR | 10-1323607 | | 11/2013 | |

OTHER PUBLICATIONS

Extended European Search Report issued in corresponding application No. 16873367, dated Sep. 13, 2019.
Office Action issued in Japanese application No. 2018-530530, dated Sep. 3, 2019.

* cited by examiner

MAGNETIC-SHIELD-TYPE CONVERTER

CROSS-REFERENCE TO RELATED APPLICATIONS

This application is a national phase application under 35 U.S.C. § 371 of International Application No. PCT/KR2016/014410, filed Dec. 9, 2016, which claims priority to and the benefit of Korean Patent Application No. 10-2015-0177272, filed Dec. 11, 2015. The contents of the referenced patent applications are incorporated into the present application by reference.

FIELD OF THE DISCLOSURE

The present disclosure relates to a current transformer, and more particularly, to a magnetically shielded current transformer capable of blocking a magnetic field applied from the outside and being manufactured in small size.

DESCRIPTION OF RELATED ART

Generally, watt-hour meters used in homes, factories, etc. are classified into mechanical watt-hour meters and electronic watt-hour meters. Electronic watt-hour meters have come into widespread use due to the advantages thereof such as high reliability, stable meter reading capability, and small size. Recently, smart meters having a telemetering function or a metering function performed in units of electronic devices installed inside a building have been introduced.

Such an electronic watt-hour meter detects a current and a voltage to calculate an amount of power used. In this case, a current is detected using a current sensor such as a current transformer, a shunt resistor, a Hall effect sensor current sensor, or a rogowski coil.

Among the above-described current sensors, the current transformer, which is relatively cheap and satisfy major features such as power consumption, electrical insulation, a variation in an output according to temperature, and a DC offset, occupies a large part of electronic watt-hour meters.

The current transformer detects a current by transforming a high current from a power supply into a low current and detects an actually supplied current according to a transformer ratio. Here, the transformer ratio is determined by a turn ratio of a coil wound around a core of the current transformer.

The current transformer includes a core (an iron core) having a specific composition therein and thus a magnetic flux generated by the core may be distorted or offset when influenced by an external magnetic field having a certain intensity or more. Accordingly, a current may not be exactly transformed, thereby causing an error to occur in detecting a current.

Reducing power consumption by generating a magnetic field using a magnet outside a watt-hour meter on the basis of the above principle, namely, "stealing electricity" may occur. In particular, stealing electricity using a magnet has increasingly occurred in low law-abiding spirit regions (e.g., developing countries).

To solve this problem, influences caused by a magnet from the outside may be decreased by securing a sufficient distance between a current transformer and an outer case of a watt-hour meter. However, increasing the distance between the current transformer and the outer case of the watt-hour meter may unnecessarily increase a whole size of the watt-hour meter and also be against the trend toward smaller devices. In particular, generally, a current transformer is unilaterally arranged inside a watt-hour meter. Thus, the size of the watt-hour meter may be more increased when the above method is employed. Accordingly, this method is not practical.

Accordingly, developing a current transformer capable of blocking influences caused by an external magnetic field, contributing to manufacturing a watt-hour meter in small size, and being manufactured in small size at low costs is in urgent demand.

SUMMARY OF THE INVENTION

To address the above problems, the present disclosure is directed to a magnetically shielded current transformer capable of blocking a magnetic field applied from the outside, being manufactured in small size and at lower costs, and contributing to manufacturing a watt-hour meter in small size.

To address the above problems, the present disclosure provides a magnetically shielded current transformer including a magnetic core module including a core formed in a ring shape by winding plate shape ribbon a plurality of times, a bobbin configured to accommodate the core, and a coil configured to be wound along an outer circumferential surface of the bobbin; a shielding member which is configured to surround an outer circumferential surface and both side surfaces of the magnetic core module, includes through-holes at centers of the both side surfaces, and is formed of iron; and an outer case configured to protect the magnetic core module and the shielding member.

According to an embodiment of the present disclosure, the shielding member may have a cylindrical shape having an inner hollow part, and include a pair of shielding cases obtained by dividing an outer circumferential surface of the cylindrical shape, and the through-holes may be respectively provided at side surfaces of the pair of shielding cases.

Sizes of sidewalls of the pair of shielding cases forming the outer circumferential surface may be the same.

Sizes of sidewalls of the pair of shielding cases forming the outer circumferential surface may be different.

A sidewall of one of the pair of shielding cases which forms the outer circumferential surface may have the same width as that of the outer circumferential surface of the cylindrical shape, and the other shielding case among the pair of shielding cases may have a plate shape.

The pair of shielding cases may include grooves at parts of the outer circumferential surface which are divided, the grooves being configured to pull out the coil therethrough.

Internal diameters of the through-holes may be greater than an external diameter of the magnetic core module.

The bobbin may include a bobbin case configured to accommodate the coil in a space between an inner cylindrical sidewall and the outer circumferential surface; and a bobbin cover configured to cover the bobbin case and having a through-hole at a center.

The bobbin case and the bobbin cover may be combined with each other by interference fit.

The bobbin case may further include a first stepped part provided at an inner side of the cylindrical sidewall; and a second stepped part provided at an inner side of the outer circumferential surface. The bobbin cover may include a protruding part extending along the through-hole toward the bobbin case. An outer circumferential side of the bobbin cover may be placed on the first stepped part. The protruding part may be placed on the second stepped part.

The coil may include an insulating coating material or insulating tape on an outer surface thereof.

The magnetically shielded current transformer may further include epoxy resin configured to be molded in the hollow part of the shielding member and an inside of the outer case.

The outer case may include a first case having a space between a cylindrical sidewall which is concentric with the through-hole of the shielding member and an outer wall provided along an outer circumferential surface thereof; and a second case having a space between a cylindrical sidewall which is concentric with the cylindrical sidewall of the first case and an outer wall provided along an outer circumferential surface thereof. The magnetic core module and the shielding member may be accommodated in the spaces of the first case and the second case.

The outer case may further include a coupling ring provided on the outer circumferential surface of the first case; and a coupling groove provided at a location on the outer circumferential surface of the second case corresponding to the coupling ring.

According to the present disclosure, an outer circumferential surface and both side surfaces of a magnetic core module are surrounded by a shielding member, so that a magnetic path may be formed by an external magnetic field, which is applied from the outside, via the shielding member. Thus, the external magnetic field is prevented from being transferred to the magnetic core module, thereby stably blocking influences caused by the external magnetic field.

According to the present disclosure, the shielding member may be formed of inexpensive iron and thus manufacturing costs of a current transformer may be reduced while satisfying the performance of blocking an external magnetic field.

According to the present disclosure, an outer circumferential surface of the shielding member having a cylindrical shape with an inner hollow part is divided by a certain size and thus the magnetic core module may be easily accommodated in the shielding member, thereby increasing convenience in a manufacturing process.

In addition, according to the present disclosure, the shielding member is formed of iron having a high shielding property and thus the current transformer and an outer case of a watt-hour meter need not be disposed apart by a certain distance from each other. Accordingly, not only the current transformer but also the watt-hour meter may be manufactured in small size.

DETAILED DESCRIPTION OF THE INVENTION

Figure 1:
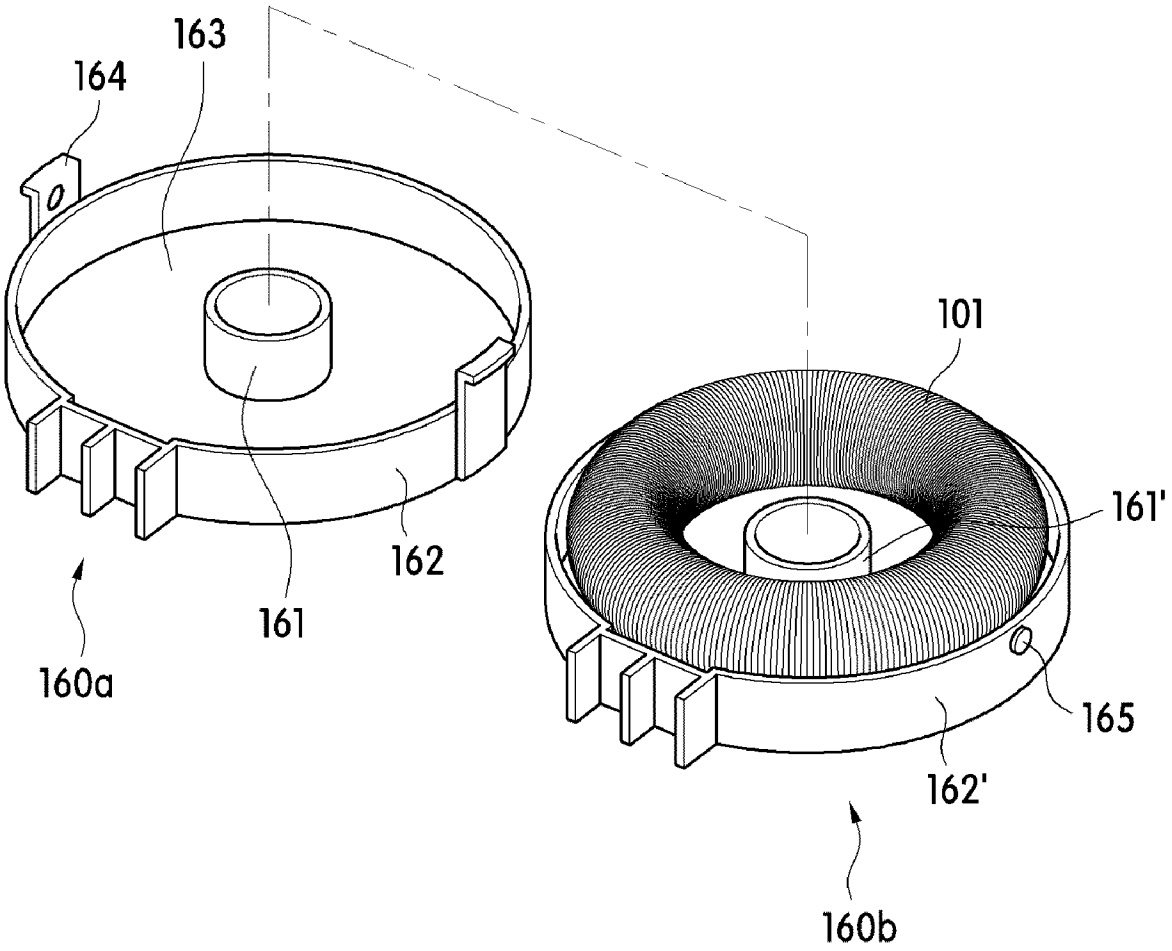
FIG. 1 is a perspective view of a magnetically shielded current transformer according to an embodiment of the present disclosure.

Hereinafter, embodiments of the present disclosure will be described in detail with reference to the accompanying drawings so that those of ordinary skill in the art can easily implement them. The present disclosure may be embodied in many different forms and should not be understood as being limited to the embodiments set forth herein. In the drawings, for clarity, parts that are not related to describing the present disclosure are omitted and the same reference numerals are allocated to same or similar components throughout the detailed description.

A magnetically shielded current transformer 100 according to an embodiment of the present disclosure includes a magnetic core module 101, a shielding member 150, and an outer case 160 as illustrated in FIGS. 1 to 4.

When a power line or a power supply line is placed into a through-hole 102 provided at a center of the magnetic core module 101, the magnetic core module 101 detects an amount of current by exciting a current generated from a magnetic force induced by a current flowing through the power line or the power supply line. The magnetic core module 101 includes a core 110, a bobbin 120, and a coil 130.

The core 110 is formed in a ring shape by winding plate shape ribbon a plurality of times. In this case, the core 110 may be formed of amorphous alloy ribbon.

The bobbin 120 accommodates the core 110 therein. The bobbin 120 may include a bobbin case 120*a* and a bobbin cover 120*b*.

The bobbin case 120*a* has a cylindrical shape of which a side is open and includes an inner cylindrical sidewall 122 which is concentric with an inner circle of the core 110. In this case, the core 110 having the ring shape may be accommodated in a space 121 between the cylindrical sidewall 122 and an outer circumferential surface of the bobbin case 120*a*.

The bobbin cover 120*b* has a plate type ring shape with a through-hole 125 at a center thereof, and covers the open side of the bobbin case 120*a*. Here, an internal diameter of the through-hole 125 may be substantially the same as that formed by the cylindrical sidewall 122.

Figure 3:
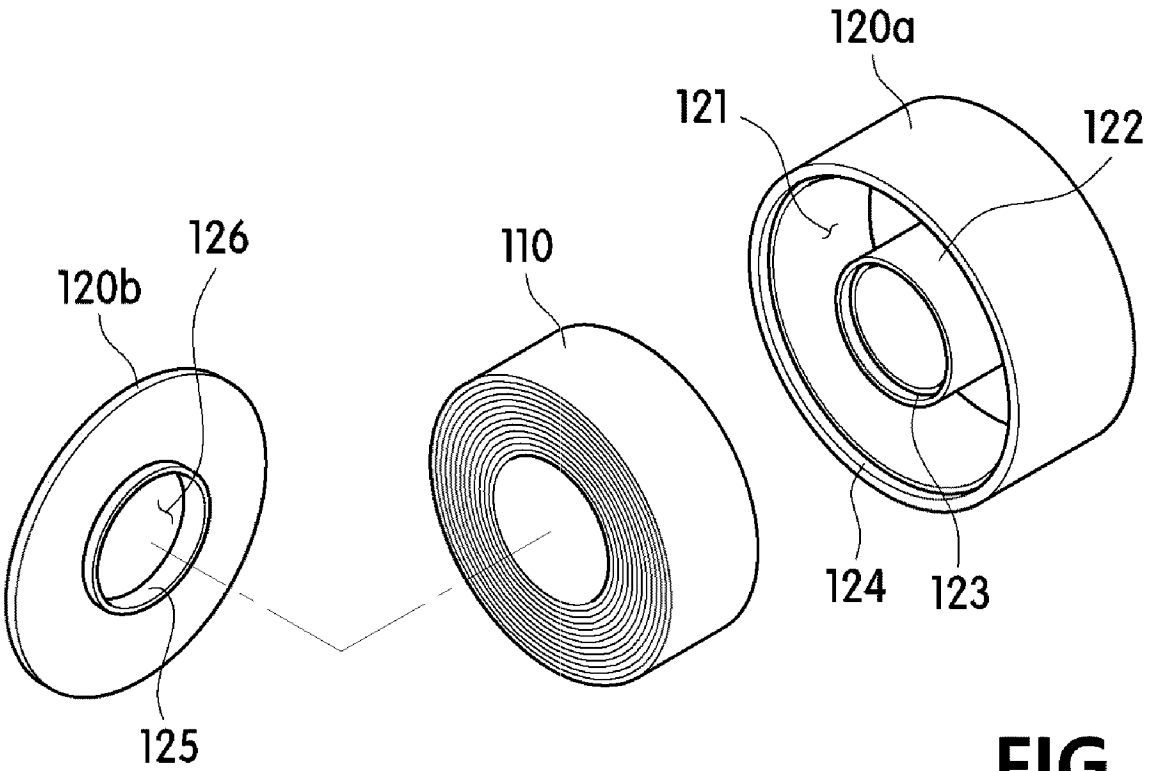
FIG. 3 is a detailed exploded perspective view of a magnetic core module of FIG. 1.

In this case, the bobbin case 120*a* and the bobbin cover 120*b* may be combined with each other by interference fit. For example, as illustrated in FIG. 3, the bobbin case 120*a* may include a first stepped part 123 provided at an inner side of the cylindrical sidewall 122, and a second stepped part 124 provided at an inner side of the outer circumferential surface of the bobbin case 120*a*. The bobbin cover 120*b* may include a protruding part 126 extending along the through-hole 125 toward the bobbin case 120*a*.

Here, the first stepped part 123 may include a step having a size corresponding to a length of the protruding part 126, and the second stepped part 124 may include a step having a size corresponding to a thickness of the bobbin cover 120*b*.

Since the first stepped part 123 and the second stepped part 124 are provided at the inner sides of the cylindrical sidewall 122 and the outer circumferential surface of the bobbin case 120*a* as described above, an outer circumferential side of the bobbin cover 120*b* may be placed on the first stepped part 123 and the protruding part 126 may be placed on the second stepped part 124.

In this case, an external diameter of the bobbin cover 120*b* is substantially the same as an internal diameter formed by the first stepped part 123 of the bobbin case 120*a*, and the internal diameter of the through-hole 125 of the bobbin cover 120*b*, i.e., an internal diameter formed by the protruding part 126, is substantially the same as an internal diameter formed by the second stepped part 124 at the inner side of the outer circumferential surface of the bobbin case

120*a*. Accordingly, the bobbin cover 120*b* may be combined with the open side of the bobbin case 120*a* by interference fit.

The coil 130 generates a current from a magnetic force induced by the core 110. The coil 130 may be wound along an outer circumferential surface of the bobbin 120. In this case, the coil 130 may be wound at a turn ratio determined by a determined current transformer ratio.

The coil 130 may include an insulating material 140 on an outer surface thereof to be prevented from being electrically connected to the shielding member 150 formed of conductive iron. For example, the insulating material 140 may be an insulating coating material or insulating tape.

The shielding member 150 is provided to surround an outer circumferential surface and both side surfaces of the magnetic core module 101. The shielding member 150 may be formed of inexpensive iron, and includes through-holes 151 formed at centers of the both side surfaces of the magnetic core module 101.

In this case, an internal diameter of the through-hole 151 is formed to be less than a diameter of the through-hole 102 of the magnetic core module 101 and greater than a diameter of a power line passing through the through-hole 102, so that the magnetic core module 101 may be completely surrounded by the shielding member 150.

As described above, when the outer circumferential surface and the both side surfaces of the magnetic core module 101 are surrounded by the shielding member 150 formed of inexpensive iron, a magnetic path is formed by an external magnetic field, which is applied from the outside, via the shielding member 150. Thus, the external magnetic field is prevented from being transferred to the magnetic core module 101 and thus manufacturing costs of the magnetically shielded current transformer 100 may be reduced while satisfying the performance of blocking the external magnetic field.

Figure 2:
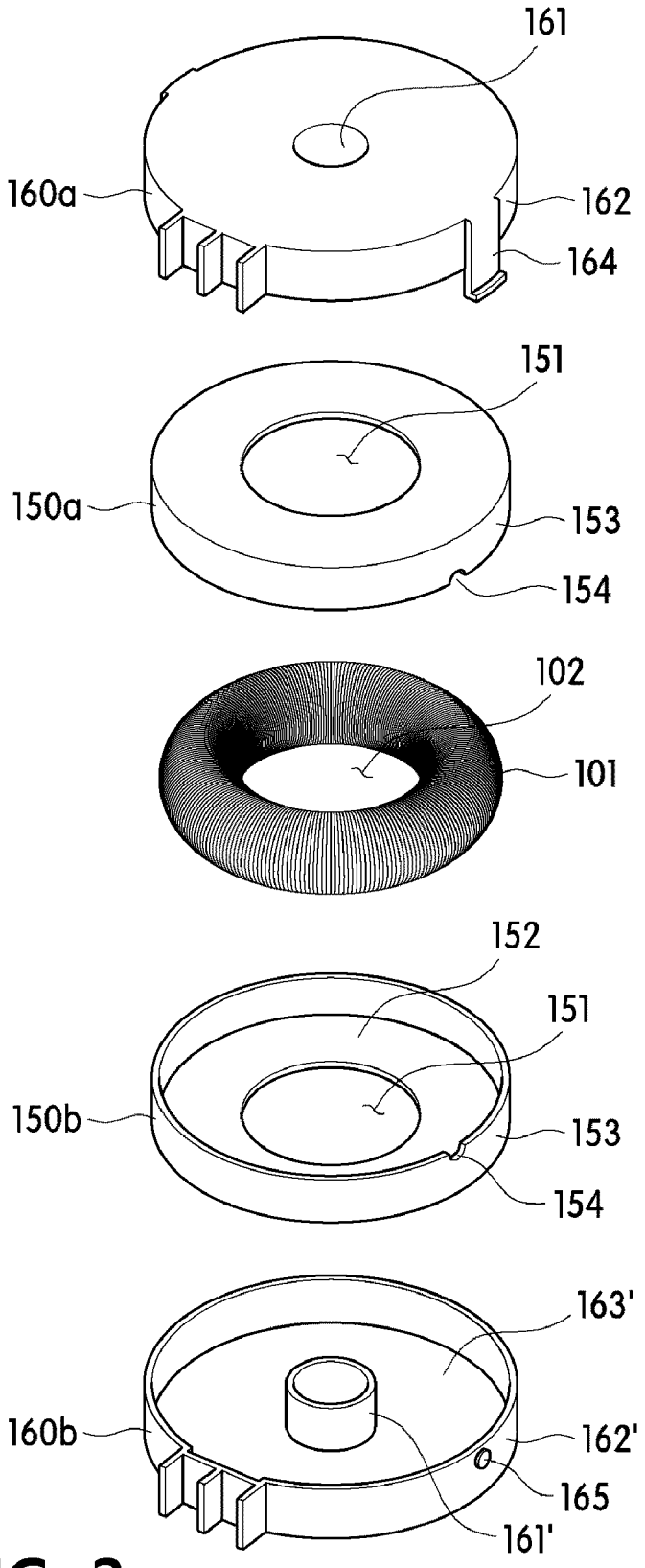
FIG. 2 is an exploded perspective view of FIG. 1.

As illustrated in FIG. 2, the shielding member 150 has a cylindrical shape having an inner hollow part 152, and includes a pair of shielding cases 150*a* and 150*b* obtained by dividing an outer circumferential surface of the cylindrical shape. In this case, the magnetic core module 101 may be placed in the hollow part 152 such that the magnetic core module 101 is surrounded by the shielding member 150.

For example, the pair of shielding cases 150*a* and 150*b* may have the same shape, in which one side thereof is open and the through-hole 151 is formed at a center of another side thereof. That is, sizes of sidewalls 153 of the pair of shielding cases 150*a* and 150*b* which form the outer circumferential surface may be the same (see FIG. 2). In this case, the through-hole 151 may be formed at a location corresponding to a side surface of each of the pair of shielding cases 150*a* and 150*b*.

Although it is illustrated and described in the present embodiment that the pair of shielding cases 150*a* and 150*b* have the sidewalls 153 having the same size, the present disclosure is not limited thereto, and the pair of shielding cases 150*a* and 150*b* may have differently sized sidewalls completely surrounding the magnetic core module 101. That is, the shielding member 150 may be divided at a certain location on the outer circumferential surface thereof.

Here, the pair of shielding cases 150*a* and 150*b* include grooves 154 at parts of the sidewalls 153 which form the outer circumferential surface and are separated, through which the coil 130 may be pulled out.

As described above, the shielding member 150 having the cylindrical shape having the inner hollow part 152 is divided along the sidewalls 153, and includes the grooves 154 at the sidewalls 153, through which the coil 130 is pulled out. Thus, the magnetic core module 101 may be easily accommodated in the shielding member 150, thereby increasing convenience of a manufacturing process.

The outer case 160 may have a function of protecting the shielding member 150 combined with the inside of the magnetic core module 101, and may include a pair of first and second cases 160*a* and 160*b*.

Here, the first case 160*a* and the second case 160*b* may respectively include a cylindrical side wall 161 and a cylindrical side wall 161' which are concentric with the through-hole 151 of the shielding member 150. In this case, spaces 163 and 163' are formed between external walls 162 and 162' provided along the sidewalls 161 and 161' and the outer circumferential surface to accommodate the magnetic core module 101 and the shielding member 150.

The outer case 160 may further include a coupling ring 164 at an outer side of the sidewall 161 of the first case 160*a*, and a coupling groove 165 formed at a location on the sidewall 161' of the second case corresponding to the coupling ring 164.

The first case 160*a* and the second case 160*b* forming the outer case 160 may be combined with each other using the coupling ring 164 and the coupling groove 165.

Furthermore, the magnetically shielded current transformer 100 may further include epoxy resin 170 molded in the hollow part 152 of the shielding member 150 and the inside of the outer case 160. The epoxy resin 170 may fix the magnetic core module 101 and the shielding member 150 inside the outer case 160 and protect the magnetic core module 101 and the shielding member 150 from externally physical and chemical impacts.

As described above, an additional shielding function is provided by molding the inside of the outer case 160 with the epoxy resin 170 having a magnetically shielding property, as well as the shielding function of the shielding member 150. Accordingly, influences caused by an external magnetic field may be further blocked using a shielding member having a small thickness and thus the magnetically shielded current transformer 100 may be manufactured in small size.

Figure 4:
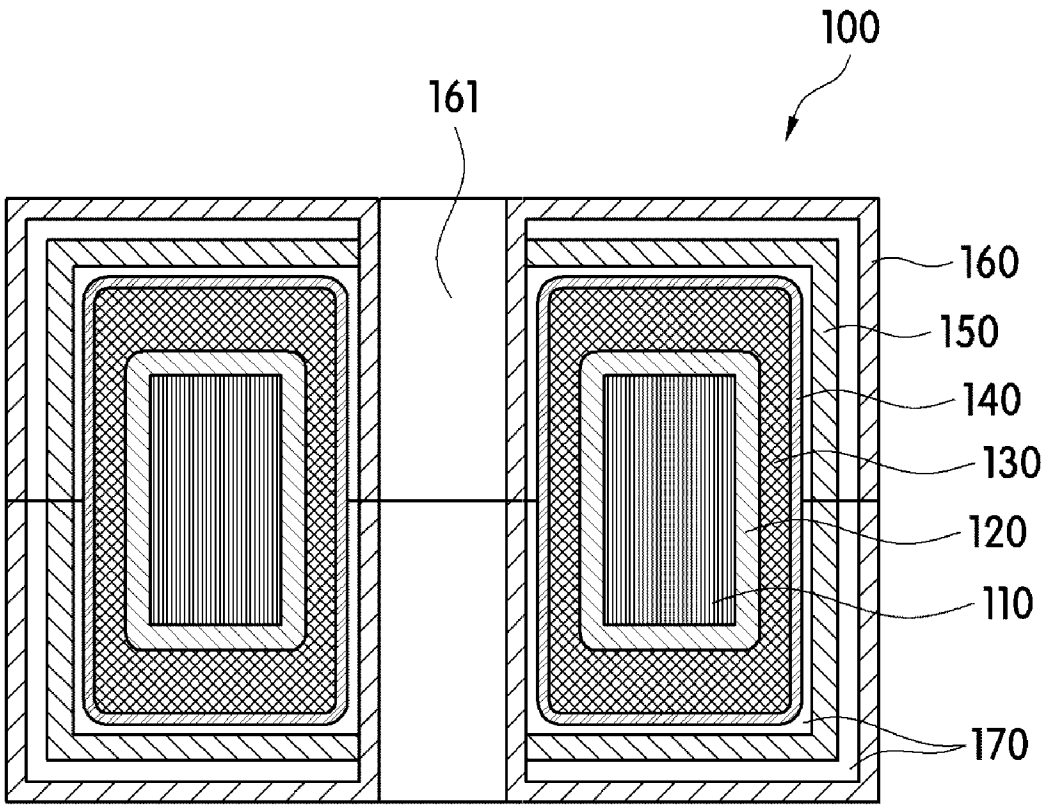
FIG. 4 is a cross-sectional view of FIG. 1.

As illustrated in FIG. 4, in the magnetically shielded current transformer 100, the magnetic core module 101 is formed by winding the coil 130 around an outer side of the bobbin 120 accommodating the core 110.

In this case, the magnetic core module 101 may be accommodated in the shielding member 150 isolated from the outside, and the shielding member 150 may be mounted in the outer case 160. Here, the epoxy resin 170 may be molded between the shielding member 150 and the magnetic core module 101 or between the shielding member 150 and the outer case 160.

Figure 5:
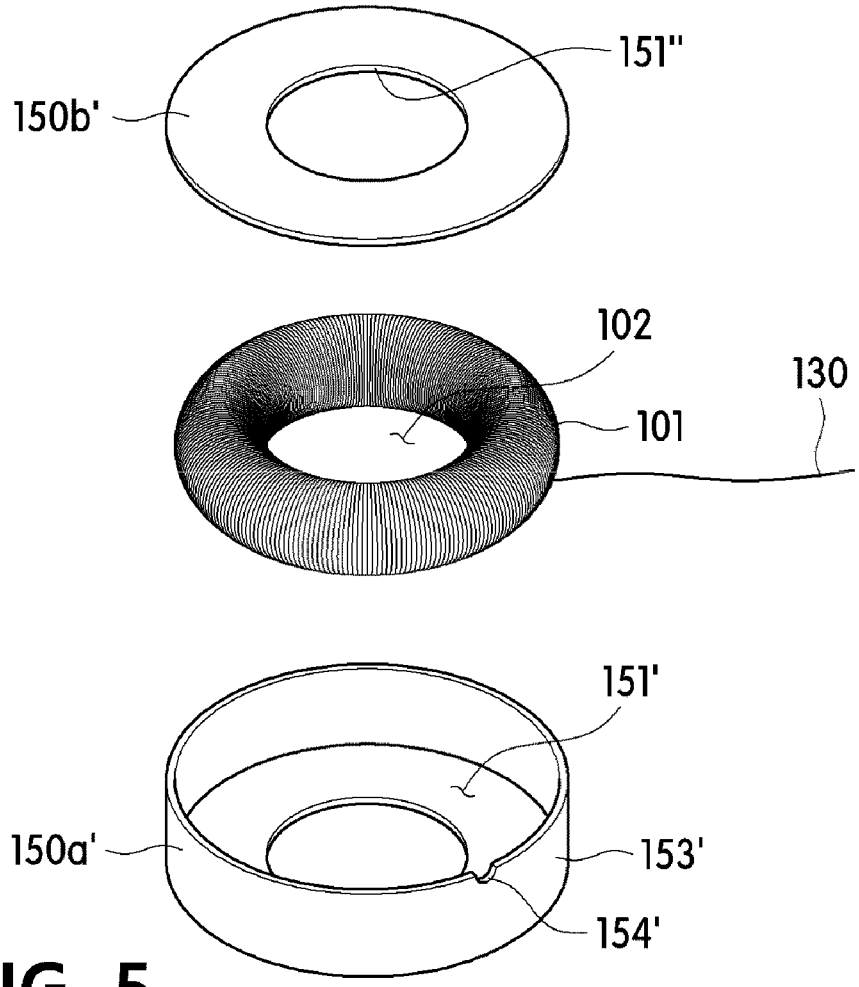
FIG. 5 is a perspective view of another example of a shielding member of a magnetically shielded current transformer according to an embodiment of the present disclosure.

As another example, as illustrated in FIG. 5, in the magnetically shielded current transformer 100 according to an embodiment of the present disclosure, a shielding member 150' may include one case 150*a*' and a plate shape cover 150*b*'.

For example, the one 150*a*' which is one of a pair of shielding cases forming the shielding member 150' may include a sidewall 153' having the same width as that of an outer circumferential surface of the shielding member 150', and the other 150*b*' of the pair of shielding cases may have a ring type plate shape.

That is, the one case 150*a*' may have a cylindrical shape of which one side is open and another side has a through-hole 151' at a center thereof. In this case, a groove 154' may be provided at the open side of the case 150*b*', via which the coil 130 is pulled out, and the cover 150*b*' may include a through-hole 151" at a center thereof.

Due to the above-described structure of the magnetically shielded current transformer 100, the magnetic core module 101 may be completely accommodated in an inner hollow part 152' formed by the sidewall 153' of the case 150*a*' and the open side of the case 150*a*' may be covered by the cover 150*b*' in a state in which the magnetic core module 101 is completely accommodated in the inner hollow part 152'. Thus, the outer circumferential surface and the both side surfaces of the magnetic core module 101 may be covered by the shielding member 150' to block an influence upon the magnetic core module 101, caused by an external magnetic field.

The magnetically shielded current transformer 100 described above may be included in a watt-hour meter to calculate an amount of power by detecting a current from a power supply.

Figure 6:
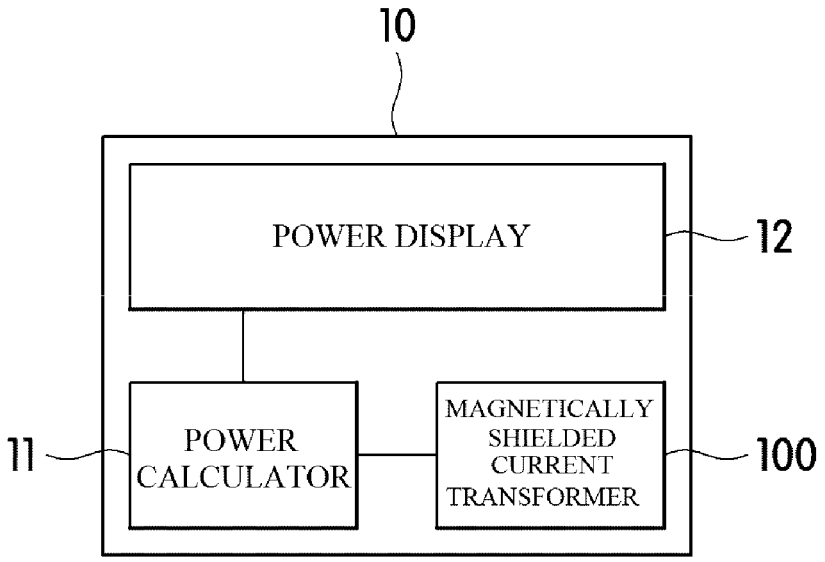
FIG. 6 is a block diagram of a watt-hour meter having a magnetically shielded current transformer according to an embodiment of the present disclosure.

As illustrated in FIG. 6, a watt-hour meter 10 includes a power calculator 11, a power display 12, and the magnetically shielded current transformer 100.

The power calculator 11 may calculate an amount of consumed power according to an amount of current detected by the magnetically shielded current transformer 100. In this case, the power calculator 11 may calculate an amount of power by transforming the detected amount of current into an actual amount of current according to a turn ratio of the coil 130 of the magnetically shielded current transformer 100.

The power display 11 may display the amount of power calculated by the power calculator 12. The power display 12 may be a display device formed of an LCD or an LED.

In the watt-hour meter 10 configured as described above, an external magnetic field may be blocked by the magnetically shielded current transformer 100 and thus an amount of power may be measured without errors while not being influenced by the external magnetic field, thereby preventing electricity from being stolen.

Furthermore, the watt-hour meter 10 is not influenced by an external magnetic field even when the magnetically shielded current transformer 100 is disposed adjacent to an outer case, and thus the components thereof may be compactly arranged without making unnecessary spaces. Accordingly, a whole size of the watt-hour meter 10 may be reduced to small size.

While embodiments of the present disclosure have been described above, the scope of the present disclosure is not limited by the embodiments set forth herein and those of ordinary sill in the art will easily derive other embodiments by adding components or changing or canceling components without departing from the scope of the present disclosure. It should be understood that the other embodiments are within the scope of the present disclosure.

The invention claimed is:

1. A magnetically shielded current transformer comprising:

a magnetic core module comprising:

a core formed in a ring shape by winding plate shape amorphous alloy ribbon a plurality of times;

a bobbin configured to accommodate the core; and a coil configured to be wound along an outer circumferential surface of the bobbin;

a shielding member configured to surround an outer circumferential surface and both end surfaces of the magnetic core module, the shielding member including through-holes at centers of the both end surfaces, and formed of iron; and an outer case configured to protect the magnetic core module and the shielding member, wherein the bobbin comprises:

a bobbin case having a cylindrical shape of which a side is open and configured to accommodate a coil in a space between an inner cylindrical sidewall and the outer circumferential surface; and a bobbin cover configured to cover the bobbin case, the bobbin cover comprising a plate type ring shape with a through-hole at a center, wherein the bobbin case further comprises:

a first stepped part provided at an inner side of the cylindrical sidewall; and a second stepped part provided at an inner side of the outer circumferential surface, and wherein the bobbin cover comprises a protruding part extending along the through-hole toward the bobbin case, wherein an outer circumferential side of the bobbin cover is configured to be placed on the second stepped part, wherein the protruding part is configured to be placed on the first stepped part, and wherein the bobbin case and the bobbin cover are configured to be combined with each other by interference fit.

2. The magnetically shielded current transformer of claim 1, wherein the shielding member has a cylindrical shape having an inner hollow part, and includes a pair of shielding cases obtained by dividing an outer circumferential surface of the cylindrical shape, wherein the through-holes are respectively provided at end surfaces of the pair of shielding cases.

3. The magnetically shielded current transformer of claim 2, wherein sizes of sidewalls of the pair of shielding cases forming the outer circumferential surface are the same.

4. The magnetically shielded current transformer of claim 2, wherein sizes of sidewalls of the pair of shielding cases forming the outer circumferential surface are different.

5. The magnetically shielded current transformer of claim 2, wherein a sidewall of one of the pair of shielding cases which forms the outer circumferential surface has the same width as that of the outer circumferential surface of the cylindrical shape, and the other shielding case among the pair of shielding cases has a plate shape.

6. The magnetically shielded current transformer of claim 2, wherein the pair of shielding cases comprises grooves at parts of the outer circumferential surface which are divided, the grooves being configured to pull out the coil therethrough.

7. The magnetically shielded current transformer of claim 1, wherein internal diameters of the through-holes are less than a diameter of a through-hole of the magnetic core module.

8. The magnetically shielded current transformer of claim 1, wherein the coil comprises an insulating coating material or insulating tape on an outer surface thereof.

9. The magnetically shielded current transformer of claim 1, further comprising epoxy resin configured to be molded in a hollow part of the shielding member and an inside of the outer case.

10. The magnetically shielded current transformer of claim 1, wherein the outer case comprises:

a first case having a space between a cylindrical sidewall which is concentric with the through-hole of the shielding member and an outer wall provided along an outer circumferential surface thereof; and a second case having a space between a cylindrical sidewall which is concentric with the cylindrical sidewall of the first case and an outer wall provided along an outer circumferential surface thereof, wherein the magnetic core module and the shielding member are accommodated in the spaces of the first case and the second case.

11. The magnetically shielded current transformer of claim 10, wherein the outer case further comprises:

a coupling ring provided on the outer circumferential surface of the first case; and a coupling groove provided at a location on the outer circumferential surface of the second case corresponding to the coupling ring.

* * * * *